US006029998A

United States Patent [19]

Woodard

[11] Patent Number: 6,029,998

[45] Date of Patent: Feb. 29, 2000

[54] CATWALK STICKS FOR PROPELLING A SNOWBOARDER

[76] Inventor: Dexter L. Woodard, 7375-F W. Kentucky Dr., Lakewood, Colo. 80226

[21] Appl. No.: 08/544,289

[22] Filed: Oct. 17, 1995

[51] Int. Cl.[7] ..... A63C 11/22

[52] U.S. Cl. ..... 280/819; 294/53.5

[58] Field of Search ..... 294/53.5, 51; 280/809, 280/816, 819, 821, 822, 823, 824; 292/128, 100, 101, 228

[56] References Cited

U.S. PATENT DOCUMENTS

| | | | |
|---|---|---|---|
| 188,311 | 3/1877 | Sparks | 292/128 |
| 472,551 | 4/1892 | Russell et al. | 292/128 |
| 529,562 | 11/1894 | Mortenson | 294/53.5 |
| 856,575 | 6/1907 | Elliott | 294/53.5 |
| 1,083,920 | 1/1914 | Clark | 294/51 |
| 1,478,204 | 12/1923 | Cooney et al. | 294/51 |

FOREIGN PATENT DOCUMENTS

| | | | |
|---|---|---|---|
| 271472 | 2/1930 | Italy | 280/816 |

*Primary Examiner*—Brian L. Johnson
*Assistant Examiner*—Avraham Lerner

[57] ABSTRACT

Catwalk Sticks are used by snowboarders for pulling themselves along flat terrain. The Catwalk Sticks include a handle, shaft and blade. The blade, which pivots on a bolt, is locked open when in use via a latch. The latch is secured to the shaft via a shaft clamp. The end of the latch that does not make contact with the blade, once pressed by a thumb, pivots the latch to release tension on the blade. This allows the user to swing the blade toward the shaft and secure the blade to the shaft via the blade clamp. Latch pressure on the blade is created by a spring, coiled around a pivot bolt that secures the latch to the shaft clamp.

1 Claim, 3 Drawing Sheets

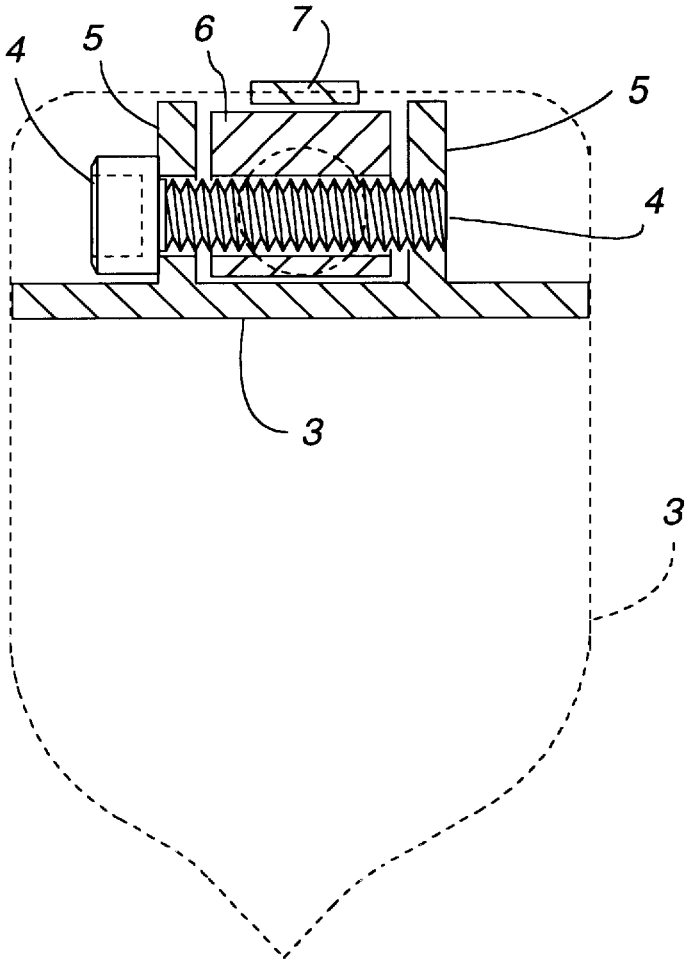
Fig. 6
Fig. 7
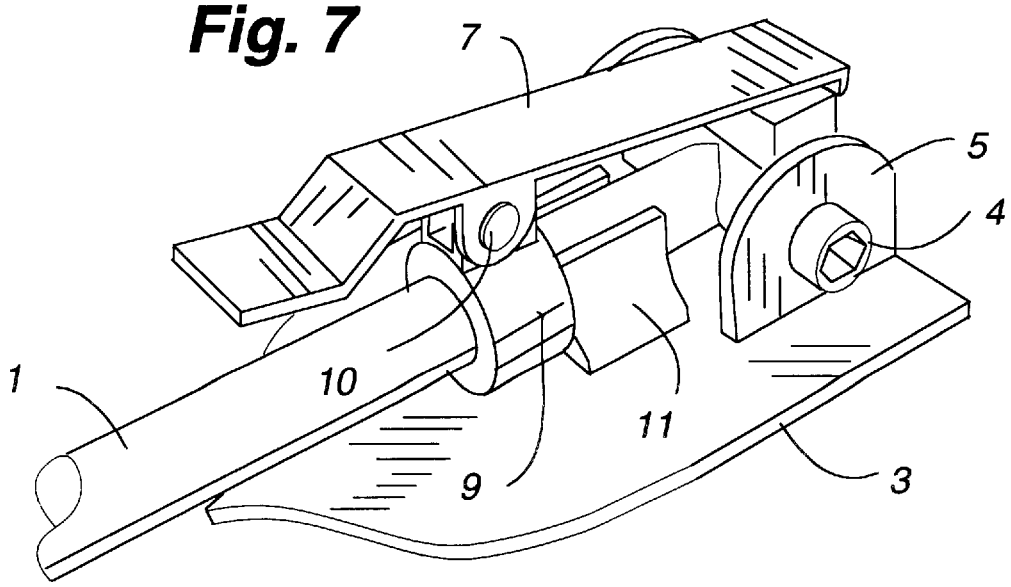

CATWALK STICKS FOR PROPELLING A SNOWBOARDER

BACKGROUND OF INVENTION

The present invention relates to a lightweight pair of hand held poles, each containing a blade on a swinging hinge which, when in the open/locked position, will assist snowboarders in pulling themselves along catwalks or flat areas of ski resorts in similar fashion that poles assist skiers in those areas.

SUMMARY OF THE INVENTION

It is the object of the invention to provide a tool that will allow snowboarders to create and maintain momentum while keeping both feet strapped into the bindings of the snowboard while on flat terrain. The Catwalk Sticks are not designed for mountain climbing, but are used in the same manner as a climber would use an ice pick to dig the blade into the snow or ice creating a firm hold, allowing the users to pull themselves along flat terrain. Presently snowboarders must unstrap the rear foot from the snowboard and push themselves along flat areas, resembling someone on a skateboard, trying to create or maintain momentum on flat sidewalks. The other current option for snowboarders in these flat areas is to unstrap both feet from the snowboard and walk while carrying the snowboard. Both approaches require a lot of effort and exhaust most snowboarders

BRIEF DESCRIPTION OF THE DRAWINGS

The present invention will be more fully understood by references to the following detailed description thereof when read in conjunction with the attached drawings wherein:

FIG. 6 is a top end view that exposes how the blade is bolted to the shaft.

FIG. 7 is a solid drawing that shows the shaft, blade, shaft clamp, blade clamp, latch and pivot bolt device.

DETAILED DESCRIPTION OF THE DRAWINGS

Figure 1:
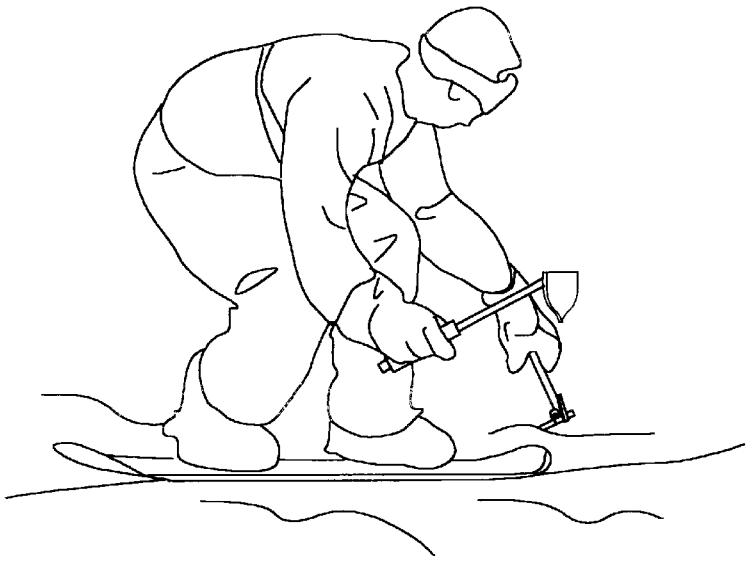
FIG. 1 is an illustration of how a snowboarder will use the invention.
Figure 2:
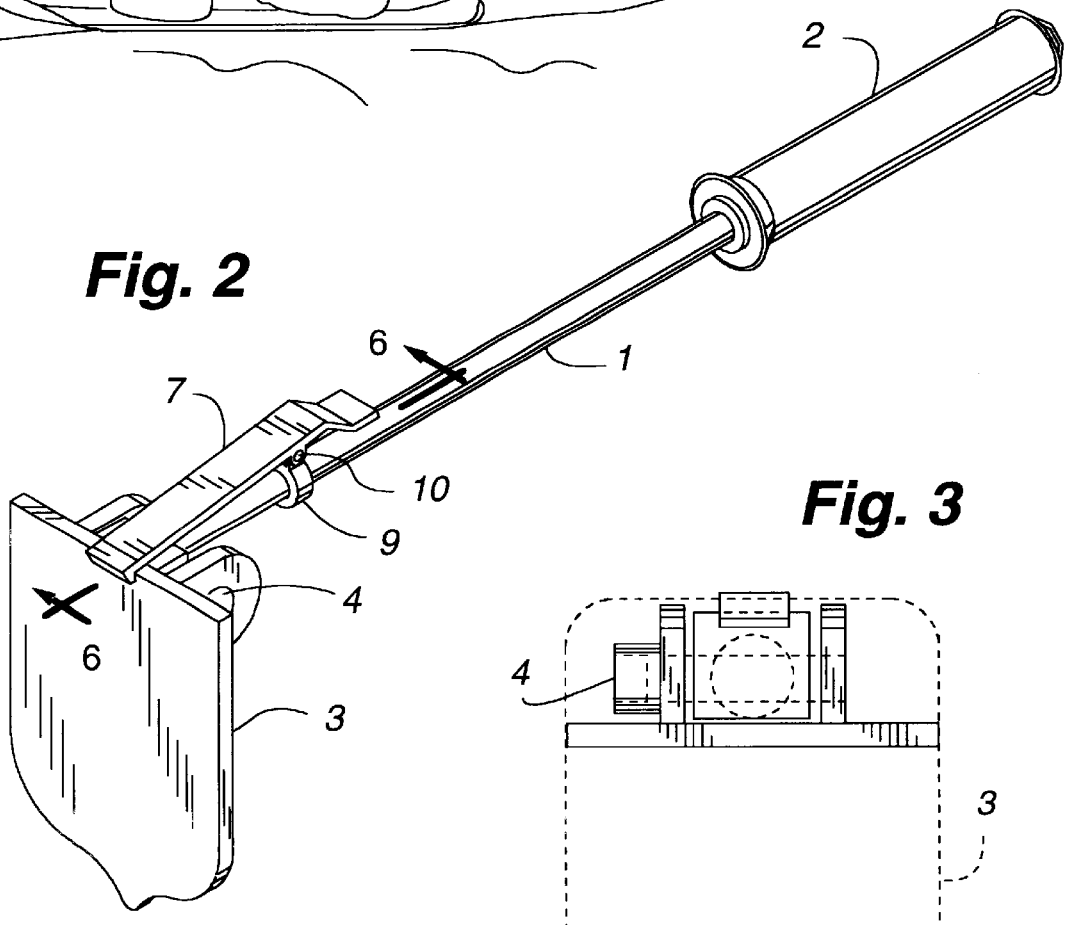
FIG. 2 is an overall view of the invention with the blade in the open position.
Figure 3:
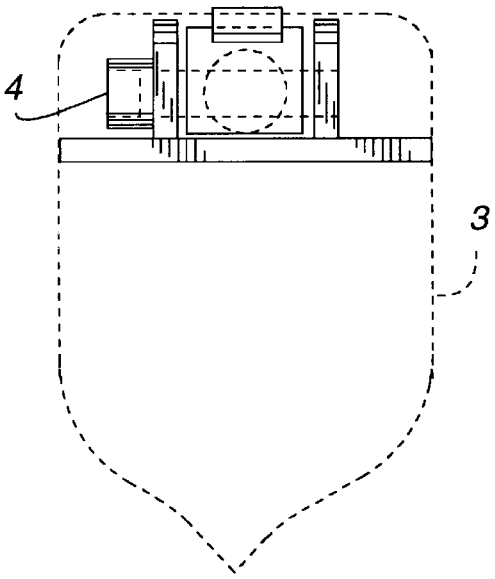
FIG. 3 is a top end view with the blade in the open position.
Figure 4:
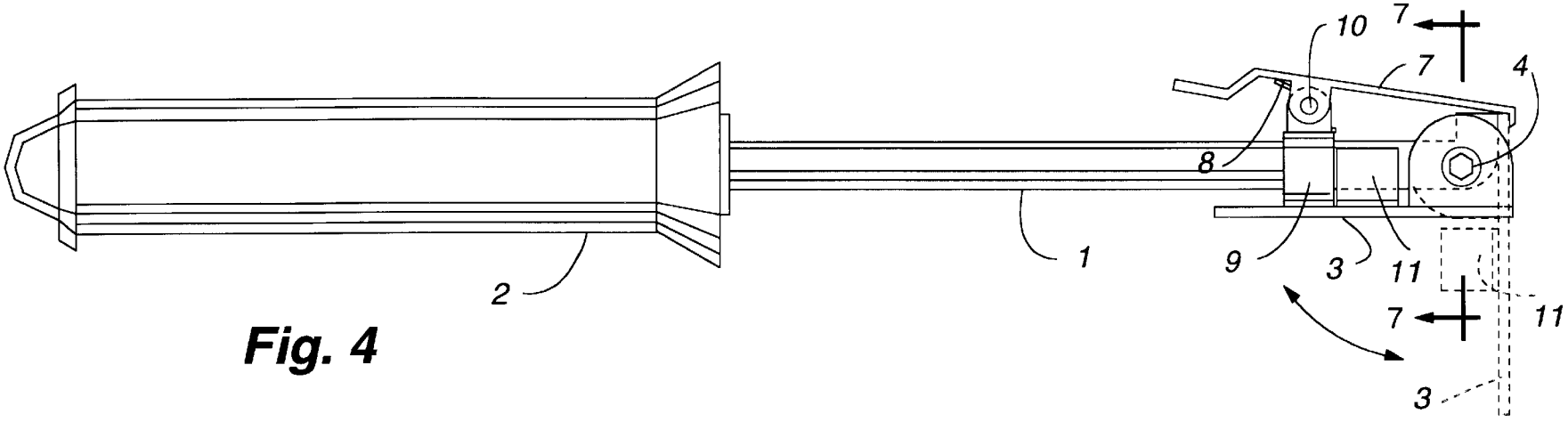
FIG. 4 is an overall view of the invention with the blade in the closed position.
Figure 5:
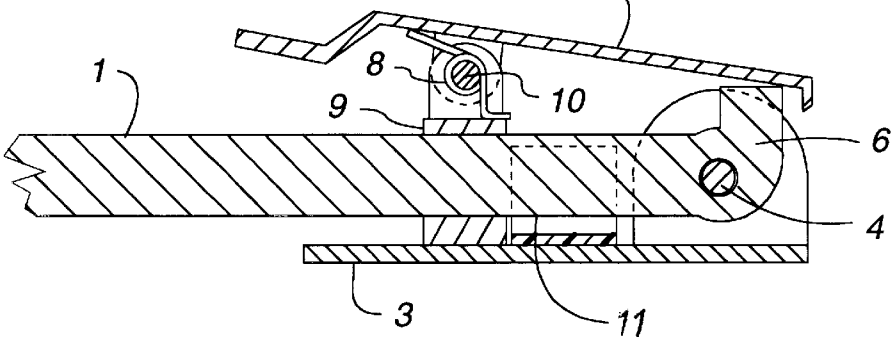
FIG. 5 is a detailed side view of the blade, shaft, spring, latch, clamps and pivot bolt device.

The invention includes a shaft, 1. At one end of the shaft is a handle, 2. Attached at the other end of shaft is a blade, 3. The blade is connected to the shaft by means of a pivot bolt device, 4. This pivot bolt device allows the blade to swing freely to both the open and closed positions. FIG. 6 shows a detailed look at how the pivot bolt device, 4 runs through the holes in the backside of the blade, 5 and the holes in the top end of the shaft, 6 connecting the blade to the shaft. The blade is locked in the open position by means of a latch, 7. The end of the latch that makes contact with the blade is bent downward towards the blade as shown in FIG. 7, securing the blade in the open position as shown in FIG. 2. The other end of the latch is made in such a way that would make it easy for the user to lock and release the blade by depressing this end with the thumb. Latch pressure on the blade is created by the spring located underneath the latch, 8. The spring is coiled around a pivot bolt, 10. This pivot bolt runs through the two holes of the shaft clamp and two holes of the latch, securing the latch to the shaft clamp, 9. The blade is secured in the closed position by means of a blade clamp, 11.

I claim:

1. A pair of catwalk sticks for propelling a snowboarder along a horizontal ground surface, each catwalk stick comprising:

a shaft, a handle fixed to a proximal end of the shaft, a blade pivotally attached to a distal end of the shaft by means of a pivot bolt extending through a hole in the shaft and through two holes in a part of the blade being selectively adjustable between two positions:

a closed position wherein a blade clamp fixed to the middle of the blade engages the shaft and releasably locks the blade substantially parallel to and adjacent the shaft, and an open position wherein a latch secures the blade in a position of use perpendicular to the shaft;

the latch being pivotally attached to the shaft by a shaft clamp and a second pivot bolt surrounded by a coil spring, the spring applying pressure to a proximal end of the latch and to the shaft clamp, which pressure biases the latch into locking engagement so as to retain the blade in the open position, and wherein release of the blade may be accomplished by pressing on said latch proximal end.

* * * * *